US008104921B2

(12) United States Patent
Hente et al.

(10) Patent No.: US 8,104,921 B2
(45) Date of Patent: Jan. 31, 2012

(54) DAYLIGHT DEFLECTION SYSTEM WITH INTEGRATED ARTIFICIAL LIGHT SOURCE

(75) Inventors: Dirk Hente, Wuerselen (DE); Wolfgang Otto Budde, Aachen (DE); Herbert Lifka, Son (NL); Peter Gerard Steeneken, Valkenswaard (NL); Peter Van De Weijer, Heeze (NL); Joseph Hendrik Anna Maria Jacobs, Eygelshoven (NL); Volker Van Elsbergen, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 189 days.

(21) Appl. No.: 12/595,656

(22) PCT Filed: Apr. 16, 2008

(86) PCT No.: PCT/IB2008/051455

§ 371 (c)(1),
(2), (4) Date: Oct. 13, 2009

(87) PCT Pub. No.: WO2008/129467

PCT Pub. Date: Oct. 30, 2008

(65) Prior Publication Data

US 2010/0067228 A1 Mar. 18, 2010

(30) Foreign Application Priority Data

Apr. 20, 2007 (EP) ..... 07106632

(51) Int. Cl.
*F21V 1/00* (2006.01)

(52) U.S. Cl. ..... 362/235; 362/238; 362/279; 362/325; 362/354

(58) Field of Classification Search ..... 362/235, 362/236, 237, 238, 249.01, 249.02, 279, 362/325, 330, 354

See application file for complete search history.

(56) References Cited

U.S. PATENT DOCUMENTS

| | | | | |
|---|---|---|---|---|
| 2,689,026 | A * | 9/1954 | Zingone | 52/507 |
| 2,859,334 | A * | 11/1958 | Guth | 362/330 |
| 7,057,821 | B2 | 6/2006 | Zincone | |
| 7,182,480 | B2 * | 2/2007 | Kan | 362/242 |
| 7,182,547 | B1 * | 2/2007 | Leonhardt et al. | 404/9 |
| 7,934,851 | B1 * | 5/2011 | Boissevain et al. | 362/241 |

FOREIGN PATENT DOCUMENTS

| | | | |
|---|---|---|---|
| DE | 20018808 | U1 | 3/2001 |
| DE | 10016587 | A1 | 10/2001 |
| DE | 20313873 | U1 | 2/2004 |

(Continued)

*Primary Examiner* — John A Ward
(74) *Attorney, Agent, or Firm* — Mark L. Beloborodov

(57) ABSTRACT

The present invention relates to a daylight deflection system including an arrangement of louvers (5) which are aligned and formed to block daylight impinging from an outer side (3) at higher angles of incidence with respect to a horizontal direction (19), to deflect daylight impinging from the outer side (3) at lower angles of incidence with respect to the horizontal direction (19) towards an indoor ceiling, and to allow visual transmission in at least the horizontal direction (19). In this deflection system OLED's (8) or optical light guides (16) coupled to LED's (17) are attached to or integrated in the louvers (5), said OLED's (8) or light guides (16) being microstructured at a surface to deflect the daylight toward the indoor sealing. With this daylight deflection system indoor lighting combining daylight and artificial light is achieved in a compact manner.

9 Claims, 2 Drawing Sheets

FOREIGN PATENT DOCUMENTS

| | | | |
|---|---|---|---|
| DE | 202004013324 | U1 | 12/2004 |
| DE | 10344213 | A1 | 7/2005 |
| DE | 102004041224 | A1 | 3/2006 |
| DE | 202005018159 | U1 | 4/2006 |
| EP | 1600688 | A1 | 11/2005 |
| WO | 9010176 | A1 | 9/1990 |
| WO | 2004007887 | A1 | 1/2004 |
| WO | 2006123283 | A2 | 11/2006 |

* cited by examiner

DAYLIGHT DEFLECTION SYSTEM WITH INTEGRATED ARTIFICIAL LIGHT SOURCE

FIELD OF THE INVENTION

The present invention relates to a daylight deflection system including an arrangement of louvers which are aligned and formed to block daylight impinging from an outer side at higher angles of incidence with respect to a horizontal direction, to deflect daylight impinging from the outer side at lower angles of incidence with respect to the horizontal direction towards an indoor ceiling, and to allow visual transmission in at least the horizontal direction.

BACKGROUND OF THE INVENTION

Daylight deflection systems for indoor lighting have received growing attention in the last years because of their ability to save energy on the one hand and to be able to provide favorable indoor lighting conditions nearly independent of the position of the sun. In contrast to commonly known venetian blinds, light deflection systems provide a glare shield for sunlight impinging at higher angles of incidence with respect to the horizontal direction, i.e. when the sun is around its highest position, blocking or reflecting the sunlight back to the outside. This also avoids overheating of the room by the sun. At lower angles of incidence with respect to the horizontal direction the louvers of the light deflection system deflect the sunlight towards the indoor ceiling, thereby also avoiding any glare through the sunlight. At the same time a visual transmission in at least the horizontal direction is maintained.

An example for such a known daylight deflection system is disclosed in DE 100 16 587 A1. The daylight deflection system of this document also comprises an artificial light source illuminating the deflection system from the inside in order to improve the indoor lighting in situations without sufficient daylight. In order to reflect the artificial light of the separately arranged light source to the inside, the louvers of this light deflection system comprise specially aligned and formed reflection surfaces for the artificial light.

SUMMARY OF THE INVENTION

It is an object of the present invention to provide a daylight deflection system, which allows the combined use of daylight and artificial light in a more compact manner.

The object is achieved with the daylight deflection system according to claim 1. Advantageous embodiments of this daylight lighting system are subject matter of the dependent claims or are described in the subsequent portions of the description.

The proposed daylight deflection system comprises an arrangement of louvers or baffles which are aligned and formed to block daylight impinging from an outer side at higher angles of incidence with respect to the horizontal direction, to deflect daylight impinging from the outer side at lower angles of incidence with respect to the horizontal direction towards an indoor ceiling, and to allow visual transmission in at least the horizontal direction from the inside to the outside. Attached to or integrated in the louvers are organic light emitting diodes (OLED's) or optical light guides. The optical light guides are coupled to light emitting diodes (LED's) and preferably include light scattering structures. The OLED's or light guides are microstructured at their surface to deflect the daylight impinging from the outer side at said lower angles of incidence towards the indoor ceiling. The higher angles of incidence are preferably angles of $\geqq 45°$ with respect to the horizontal direction. The lower angles of incidence are preferably angles of $<45°$ with respect to the horizontal direction.

With the proposed daylight deflection system external sunlight is blocked or back reflected for high sun periods and deflected towards the interior ceiling for incoming sunlight at low angles. With the integrated or attached OLED's or LED coupled optical light guides artificial light is generated for indoor room illumination when not enough sunlight is available for indoor lighting. A main aspect of the present invention is the microstructuring of the surface of the light guides or OLED's. Due to the microstructuring the deflection of the sunlight to the indoor ceiling is ensured and not deteriorated with respect to commonly known daylight deflection systems without such integrated light guides or OLED's. The microstructure can even improve the deflection efficiency of sunlight, which impinges at said lower angles, towards the ceiling. This microstructuring is possible due to the properties of OLED's and light guides. Light guides are made of an optically transparent material which may be for example a glass material or a transparent plastic material. In any case, this material can easily be microstructured with known techniques like galvanic processes, lithography and etching, embedding microparticles or printing. The same applies to the attached or integrated OLED's. OLED's are generally formed of an active light emitting material sandwiched between two electrode structures. This sandwich is arranged on a transparent substrate which also may be of a glass or a transparent plastic material. Using this transparent substrate as the light emitting side of the OLED, this substrate can be microstructured in the same manner as the above light guide.

The OLED as well as the light guide can be fabricated to follow at least any macroscopic form of the louvers which is needed to achieve the desired daylight deflection effect. The detailed construction of the louvers is not part of the present invention. The attached or integrated OLED's or light guides may be used with any kind of louvers in daylight deflection systems.

In an advantageous embodiment the OLED's are segmented to provide several OLED segments side by side on each louver. These OLED segments are electrically contacted individually to be able to emit light independent from another. This separate control allows together with an appropriate control device to generate interesting light emitting effects with these OLED segments. The OLED segments may also be dimensioned and arranged such that the whole daylight deflection system can be used for signage, e.g. as an indoor or outdoor display, for example for atmosphere creation, for advertising or as an information or entertainment medium.

In another embodiment of the invention, the louvers are designed to have at least two portions, a first portion of which is aligned and formed to block sunlight impinging at higher angles of incidence, i.e. at high profile angles of the sun, and the second portion of which is aligned and formed to deflect the sunlight when impinging at lower angles of incidence, i.e. at lower profile angles, towards the indoor ceiling. The first portion provides a first surface area directed towards the outside. The second portion joins towards the inside having an appropriate surface for the deflection of the sunlight. The OLED's or light guides having the microstructured surface are arranged at this second surface area.

In a further embodiment additional OLED's are integrated or attached at the first surface area or portions thereof directed to the outside. These additional OLED's preferably are not microstructured but are segmented and individually controllable to allow the deflection system to be operable for signage, e.g. as a display. With sufficiently segmented or pixelated OLEDs directed to the outside, the light deflection system may be used as a display for advertising or as an information or entertainment medium for persons outside. This requires a control device for controlling the individual OLED segments dynamically to provide the intended display effect.

In an embodiment using the light guides coupled to LED's, the LED's are preferably arranged at one or both of the small sides of the louvers to couple the emitted light into the light guides. The light guides preferably comprise internal or external light scattering structures to improve the emission of the transported light through the free surface to the outside of the light guides. These structures may be distributed homogenously throughout the light guides to provide a homogeneous light emission. It is also possible to provide such structures only locally in a uniform or not uniform pattern for local emission in the desired pattern like structure. The structures may be single particles or groups of particles embedded in the light guide. The structures my also be formed from a paint or scattering layer applied to a surface of the light guide.

The light emission through the surface may also be effected by the microstructure on the surface of the light guides.

The daylight deflection system according to the present invention integrates artificial light sources in form of OLED's or LED coupled light guides into the components of the deflection system and makes use of specific properties of OLED's and light guides, in particular of the microstructuring possibility of the substrate. By integration of the OLED's or light guides in the louvers of the deflection system, the design requirements for the deflection profile are significantly relaxed. The otherwise unused surface can be utilized to improve the room illumination and allows the creation of atmosphere effects. Additionally, the OLED's can be arranged at surfaces directed to the outside and separated into small segments or tiles. By dynamically driving such a pixelated deflection system like a display it can be used for example for advertising or other event like light effects.

These and other aspects of the invention will be apparent from and elucidated with reference to the embodiments described herein after.

BRIEF DESCRIPTION OF THE DRAWINGS

The proposed daylight deflection system is described in the following by way of examples in connection with the accompanying figures without limiting the scope of protection as defined by the claims. The figures show:

DETAILED DESCRIPTION OF EMBODIMENTS

Figure 1:
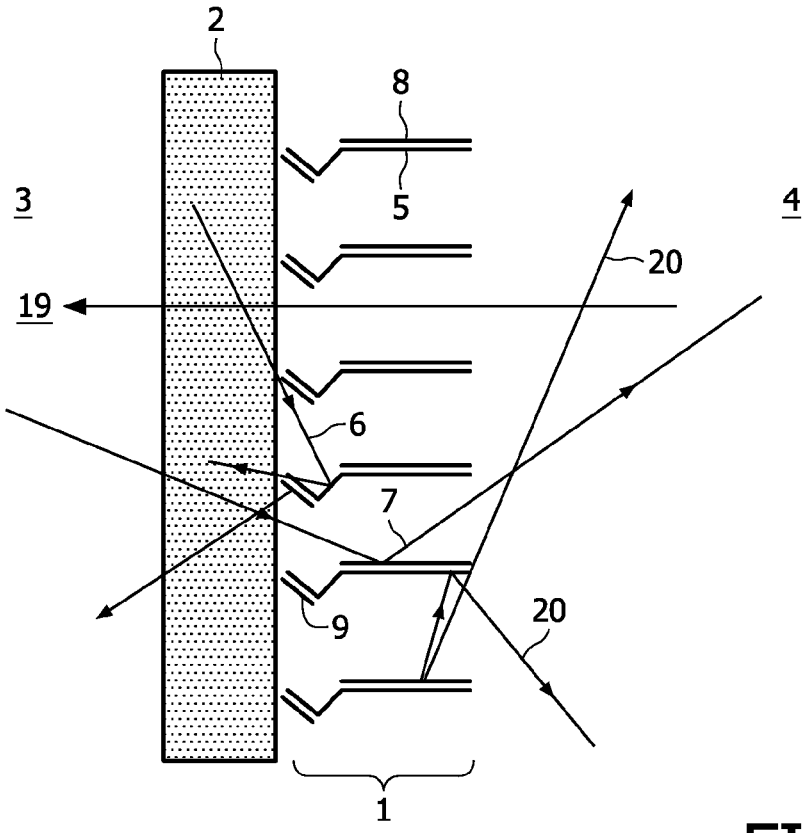
FIG. 1 a schematic side view of a daylight deflection system according to the present invention.

The proposed daylight deflection system is schematically depicted in FIG. 1 showing one possible example of the deflection system. The figure shows the exemplary deflection system 1 in a side view. The deflection system 1 is arranged behind of a window 2 which separates the exterior 3 of a building from the inside 4. The deflection system is composed of several louvers 5 of an opaque material which are arranged in a known manner parallel to each other extending horizontally at the window. In FIG. 1 these louvers 5 extend with their longest extension perpendicular to the paper plane.

As can be seen from the figure, the louvers 5 comprise two portions which have different functions. The outer portion having a groove like structure is designed to reflect sunlight impinging at a steep angle with respect to the horizontal direction 19 back to the outside. This blocked sunlight 6 is indicated as one single sunbeam in the figure. The inner second portion of the louvers 5 is aligned and formed to deflect sunlight impinging at lower angles with respect to the horizontal direction 19 towards the ceiling of the inside of the building or room. This deflected sunlight 7 is also indicated as one a single sunbeam in the figure.

In the present example, OLED's 8 are attached to the surface of the louvers 5 which deflects the sunlight towards the indoor ceiling of the room. In order to ensure this deflection, the OLED's 8 are microstructured at their surface to allow or even improve this deflection. The microstructure is not depicted in FIG. 1. On the other hand, the OLED's 8 can be driven to emit light for additional illumination of the inside, for example if the daylight is not sufficient, in particular at night. In this case, as is indicated with a further single beam in the figure, a part of the artificial light 20 emitted by the OLED's 8 directly illuminates the ceiling, whereas another part is reflected downwards at the bottom of the upper neighboring louver. The OLEDs 8 are electrically contacted via thin conductors integrated in the louvers 5.

In the exemplary embodiment of FIG. 1 the first portion of the louver 5 for blocking or back reflecting the sunlight provides a surface portion which is directed towards the exterior 3, in this case in a downside direction. Further OLED's 9, which are not microstructured at their surface, are attached to these surface portions to provide outside illumination effects at night. These further OLED's 9 may be segmented and electrically contacted to be driven individually. In this case, the OLED segments can be dynamically driven like a display to provide desired information, effects or advertising for the exterior.

The microstructured OLED's 8 may be segmented and driven in a similar manner to provide such a display for the inside.

Figure 2:
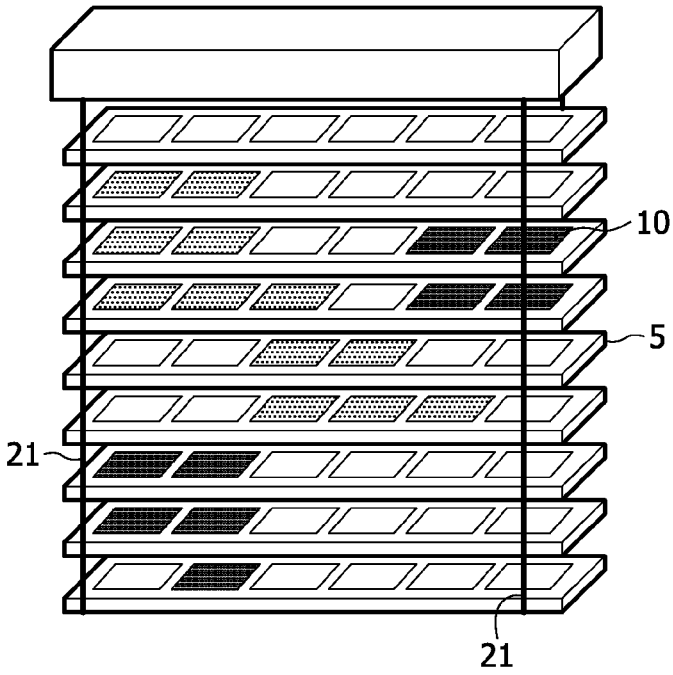
FIG. 2 a further schematic view of a daylight deflection system according to the present invention.

FIG. 2 is a schematic view showing a possible segmentation of the OLED's. The OLED segments 10 are arranged side by side on the louvers 5 and can be controlled individually in order to provide a display light system. The required geometrical form of the louvers for the blocking and deflection of daylight is not shown in this figure.

Figure 3:
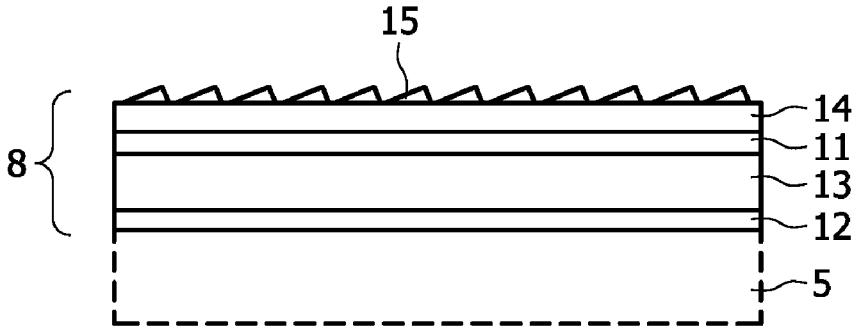
FIG. 3 a schematic view of an OLED used in a daylight deflection system of the present invention.

FIG. 3 shows an example of an OLED 8 which can be used in a deflection system according to FIG. 1 in a schematic cut view. The OLED 8 is composed of an active light emitting organic material 13 sandwiched between two electrodes 11, 12. This sandwich structure is mounted on an optically transparent substrate 14 as known in the art. The cathode 12 is preferably made of an optically reflecting metallic material like aluminium. The anode 11 can be made of an optically transparent material like ITO or can be formed in a grid like structure to allow the transmission of the generated light. Such an OLED is also known as a bottom emitting OLED, since the emission is directed through the transparent substrate 14, which will be made of glass or an optically transparent plastic material. The surface of the transparent substrate 14 is micro structured to form microprisms 15 as can be recognized from FIG. 3. These microprisms 15 are dimensioned such that the daylight impinging at the lower angles on the surface of this substrate is deflected towards the inner ceiling of the room at which the deflection system is arranged.

The physical mechanism for this deflection is the total reflectance of the daylight at the interface between air and the microprisms 15.

In the proposed deflection system, such an OLED 8 may be attached, for example by gluing, to the louver 5. It is also possible to form the louvers 5 directly of the OLED's. In this case, the substrate 14 must be sufficiently stiff to allow to be used as a louver and the downside electrode 12 must be sufficiently opaque to block light. In such an embodiment also an additional protection layer may be provided on the cathode 12.

Figure 4:
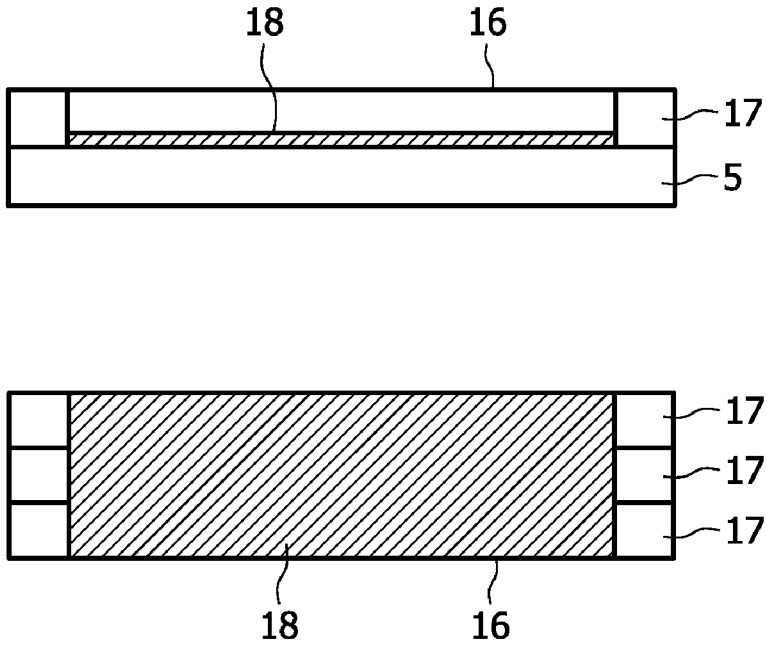
FIG. 4 a schematic view of a LED coupled light guide used in a daylight deflection system according to the present invention.

FIG. 4 shows an example of the attachment of light guides 16 to the louvers 5. The upper part of FIG. 4 is an exemplary cut view of a simplified louver 5 with an attached light guide 16. The cut is along the longitudinal axis of the louver 5. At both small sides of the louver 5 LED's 17 are arranged to couple artificial light into the light guide 16. The light guide 16 is made of a glass or optically transparent plastic material with an applied layer 18 of reflecting paint. This layer ensures that the light passing through the light guide is also emitted through the upper surface of the light guide 16.

The lower part of FIG. 4 shows a topview of such a structure. From this topview of the light guide 16 in this example several LED's 17 can be recognized which are arranged at the smaller sides of the louvers. Such light guides 16 together with the LED's 17 for light generation can be used instead of the OLED's 8 in FIG. 1. In the example of FIG. 4, the surface structure of the light guide 16 is not shown. This structure is the same as the surface structure of the substrate 14 of FIG. 3.

As one example, the required power to drive the OLED and/or LED light sources may be supplied via the pull cords 21 connected to a power supply. The pull cords may be made out of a conducting material or may contain conducting wires. In another embodiment, the power supply may be integrated within the louvers 5. People skilled in the art may also consider alternative solution to supply a driving voltage to the light sources.

While the invention has been illustrated and described in detail in the drawings and forgoing description, such illustration and description are to be considered illustrative or exemplary and not restrictive, the invention is not limited to the disclosed embodiments. The different embodiments described above and in the claims can also be combined. Other variations to the disclosed embodiments can be understood and effected by those skilled in the art in practicing the claimed invention, from a study of the drawings, the disclosure and the appended claims. For example, the light guides may not only be attached to the louvers but may also form the louvers. Generally, the louvers may be fixed or movable, in particular rotatable around their longitudinal axes. Rotatable louvers allow an additional adaptation to the angle of the impinging sunlight. Although in the examples shown the surfaces of the louvers are plan surfaces, these surfaces may also be curved.

In the claims, the indefinite article "a" or "an" does not exclude a plurality. The mere fact that measures are recited in mutually different dependent claims does not indicate that a combination of these measures can not be used to advantage. Any reference signs in the claims should not be construed as limiting the scope of these claims.

LIST OF REFERENCE SIGNS

1 daylight deflection system
2 window
3 exterior
4 inside
5 louver
6 blocked sunlight
7 deflected sunlight
8 OLED with microstructured surface
9 OLED for outside illumination
10 OLED segment
11 anode
12 light reflecting cathode
13 light emitting material
14 optically transparent substrate
15 microprisms
16 light guide
17 LED's
18 layer of light reflecting paint
19 horizontal direction
20 artificial light
21 pull cord

The invention claimed is:

1. Daylight deflection system, including an arrangement of louvers comprising a plurality of OLED's or optical light guides coupled to LED's attached thereto or integrated therein, said OLED's or optical light guides having a microstructured surface, the arrangement of louvers being aligned and formed to block daylight impinging from an outer side at higher angles of incidence with respect to a horizontal direction, to deflect daylight impinging from the outer side at lower angles of incidence with respect to the horizontal direction towards an indoor ceiling, and to allow visual transmission in at least the horizontal direction.

2. Daylight deflection system according to claim 1, wherein the OLED's are segmented providing several OLED segments side by side at each louver, said OLED segments being controllable to emit light independent from one another.

3. Daylight deflection system according to claim 1, wherein each louver comprises at least two portions, a first portion of which at the outer side being formed to have a first surface area blocking the daylight impinging at the higher angles and a second portion of which at an inner side being formed to have a second surface area for deflecting the daylight impinging at the lower angles towards the indoor ceiling.

4. Daylight deflection system according to claim 3, wherein the OLED'or light guides are arranged at the second surface area.

5. Daylight deflection system according to claim 4, wherein further OLED's are arranged at the first surface area or at a part of the first surface area which is directed towards the outer side, said further OLED's being segmented and individually controllable allowing the further OLED's of the deflection system to be operable as a display.

6. Daylight deflection system according to claim 1,wherein the OLED's are segmented providing several OLED segments which are individually controllable to allow the OLED's of the deflection system to be operable as a display.

7. Daylight deflection system according to claim 1, wherein the OLED's or light guides are microstructured to form micro prisms at the surface.

8. Daylight deflection system according to claim 1, wherein the light guides include light scattering structures.

9. Daylight deflection system according to claim 1, wherein at least light scattering structure is applied to a surface of the light guides.

* * * * *